US009601294B2

(12) United States Patent
Nohara

(10) Patent No.: US 9,601,294 B2
(45) Date of Patent: Mar. 21, 2017

(54) FUSE UNIT

(71) Applicant: Yazaki Corporation, Tokyo (JP)

(72) Inventor: Mami Nohara, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/637,463

(22) Filed: Mar. 4, 2015

(65) Prior Publication Data

US 2015/0179379 A1 Jun. 25, 2015

Related U.S. Application Data

(63) Continuation of application No. PCT/JP2013/074619, filed on Sep. 12, 2013.

(30) Foreign Application Priority Data

Sep. 20, 2012 (JP) ..... 2012-206632

(51) Int. Cl.

| | |
|---|---|
| ***H01H 71/16*** | (2006.01) |
| ***H01H 85/12*** | (2006.01) |
| ***H01H 85/20*** | (2006.01) |
| ***H01H 85/38*** | (2006.01) |
| ***H01H 85/175*** | (2006.01) |
| *H01H 85/02* | (2006.01) |
| *H01H 85/055* | (2006.01) |

(52) U.S. Cl.

CPC ..... *H01H 71/16* (2013.01); *H01H 85/12* (2013.01); *H01H 85/175* (2013.01); *H01H 85/20* (2013.01); *H01H 85/38* (2013.01); *H01H 2071/167* (2013.01); *H01H 2085/025* (2013.01); *H01H 2085/0555* (2013.01); *H01H 2085/383* (2013.01)

(58) Field of Classification Search

CPC ..... H01H 71/16; H01H 85/175; H01H 85/12; 2071/167; H01H 2085/383; H01H 2085/0555; H01H 2085/025

USPC 337/68, 75, 186, 310, 95, 86, 78, 383, 370, 337/322, 273, 293, 197, 159, 207

See application file for complete search history.

(56) References Cited

U.S. PATENT DOCUMENTS

2002/0163416 A1* 11/2002 Matsumura ..... H01H 85/044 337/112
2012/0286922 A1* 11/2012 Matsumoto ..... H01H 85/0078 337/206

FOREIGN PATENT DOCUMENTS

| | | | |
|---|---|---|---|
| JP | 2002-329457 | A | 11/2002 |
| JP | 2005-339965 | A | 12/2005 |
| JP | 2006-140024 | A | 6/2006 |
| JP | 2009-283367 | A | 12/2009 |

OTHER PUBLICATIONS

International Search Report for PCT/JP2013/074619 dated Dec. 3, 2013.

* cited by examiner

*Primary Examiner* — Stephen Sul
(74) *Attorney, Agent, or Firm* — Sughrue Mion, PLLC

(57) ABSTRACT

In a fuse unit that includes a bus bar whose bend parts separated from each other are arranged in parallel, and one pair of divided bodies formed by being divided into one side and the other side of the bus bar with the bend parts exposed, and in which the one pair of divided bodies is arranged into an L-letter shape by being bent at the bend parts, a partition wall that is to be arranged between the bend parts in a state of leaving the bend parts bent is provided on one divided body.

6 Claims, 10 Drawing Sheets

FUSE UNIT

CROSS REFERENCE TO RELATED APPLICATIONS

This application is a Continuation of PCT Application No. PCT/JP2013/074619, filed on Sep. 12, 2013, and claims the priority of Japanese Patent Application No. 2012-206632, filed on Sep. 20, 2012, the content of both of which is incorporated herein by reference.

TECHNICAL FIELD

The present invention relates to a fuse unit.

BACKGROUND ART

Conventionally, as a fuse unit, there has been known a fuse element as a bus bar in which at least two flexible parts as bend parts separated from each other are arranged in parallel, and one divided body and the other divided body as one pair of divided bodies formed by being divided into one side and the other side of the fuse element with the flexible parts exposed (see, for example, Patent Literature 1).

In this fuse unit, the flexible parts of the fuse element are bent and thereby one divided body and the other divided body are arranged into an L-letter shape. Enlargement of the fuse unit along its full length can be suppressed and it becomes possible to cope with diversification of fuse circuits by forming the fuse element into the L-letter shape in this way.

CITATION LIST

Patent Literature

Patent Literature 1: Japanese Patent Laid-Open Publication No. 2002-329457

SUMMARY OF INVENTION

Technical Problem

Incidentally, in a fuse unit such as that in the above-mentioned Patent Literature 1, there are two bend parts of the bus bar, and the bend parts are separated from each other. That is, since they configure separate circuits, it is necessary to insulate the bend parts from each other. Therefore, the adjacent bend parts are arranged apart from each other.

However, in the fuse unit such as that in the above-mentioned Patent Literature 1, since the bend parts are exposed from the one pair of divided bodies, the adjacent bend parts are electrically conducted together due to atmospheric discharges and so forth and there was the possibility that leakage would occur.

Accordingly, this invention aims to provide a fuse unit capable of preventing the leakage that would occur between bend parts that are exposed from one pair of divided bodies.

Solution to Problem

A fuse unit according to the present invention includes: a bus bar whose at least two bend parts separated from each other are arranged in parallel; and one pair of divided bodies formed by being divided into one side and the other side of the bus bar with the bend parts exposed, the one pair of divided bodies being arranged into an L-letter shape by being bent at the bend parts, in which a partition wall that is to be arranged between the bend parts in a state of leaving the bend parts bent is provided on either one of the one pair of divided bodies.

It is preferable that an isolation depression part that is provided between the bend parts and in which the partition wall is to be arranged in the state of leaving the bend parts bent be provided in the other one that is different from the one on which the partition wall is provided in the one pair of divided bodies.

It is preferable that a locking part that attains engagement in the state of leaving the bend parts bent to restrict bending of the bend parts be provided on the one pair of divided bodies.

It is preferable that the locking part comprises a locking depression part that is provided in either one of the partition wall and the other divided body and a locking projection part that is provided on the other one of the partition wall and the other divided body and is to be engaged with the locking depression part.

DESCRIPTION OF EMBODIMENTS

Figure 1:
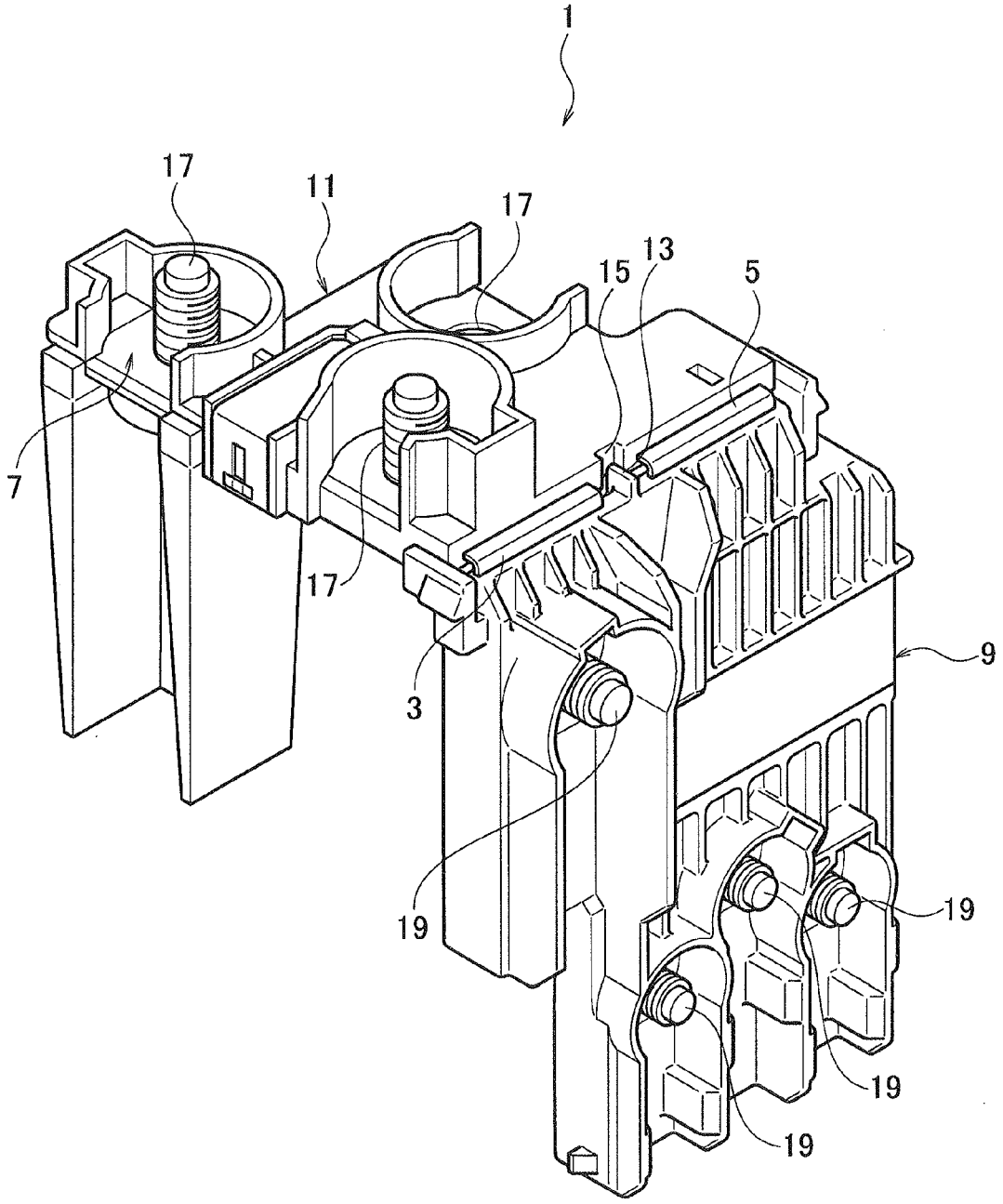
FIG. 1 is a perspective view of a fuse unit according to a first embodiment of the present invention.

Fuse units according to embodiments of the present invention will be described by using the drawings.

First Embodiment

A first embodiment will be described by using FIG. 1 to FIGS. 4A and 4B.

A fuse unit 1 according to the present embodiment is provided with a bus bar 7 that bend parts 3, 5 that are separated from each other are arranged in parallel, and one pair of divided bodies 9, 11 formed by being divided into one side and the other side of the bus bar 7 with the bend parts 3, 5 exposed. The one pair of divided bodies 9, 11 is arranged into an L-letter shape by being bent at the bend parts 3, 5.

Then, a partition wall 13 that is to be arranged between the bend parts 3, 5 in a state of leaving the bend parts 3, 5 bent is provided on one divided body 9.

In addition, an isolation depression part 15 that is provided between the bend parts 3, 5 and into which the partition wall 13 is to be arranged in the state of leaving the bend part 3, 5 bent is provided in the other divided body 11.

The bus bar 7 is made of a conductive material and is formed into a sheet shape. In addition, a fuse (not shown) that fuses with overcurrent is formed integrally with the bus bar 7.

As shown in FIG. 1, in this bus bar 7, a plurality of upper surface connection parts 17 to which a battery terminal (not shown), a alternator terminal (not shown), a starter motor (not shown) and so forth are to be connected are provided on parts located on the upper surface side of a battery (not shown), and a plurality of side-surface connection parts 19 to which terminals that are connected to loads such as electrical components and so forth are to be connected are provided on parts located on the side-surface side of the battery.

The bus bar 7 like this serves as a fuse element that configures a fuse circuit that is arranged between the battery and the load to connect together the battery and the load via the fuse. The bend parts 3, 5 that are separated from each other are provided on this bus bar 7.

The bend parts 3, 5 are separately arranged in parallel and configure different fuse circuits respectively. The fuse unit 1 is formed into the L-letter shape by bending the bend parts 3, 5. Enlargement of the fuse unit 1 along its full length can be suppressed, it becomes possible to prevent interference with the peripheral member of the battery and it becomes possible to cope with diversification of the fuse circuits by forming the fuse unit 1 into L-letter shape in this way.

Figure 3A:
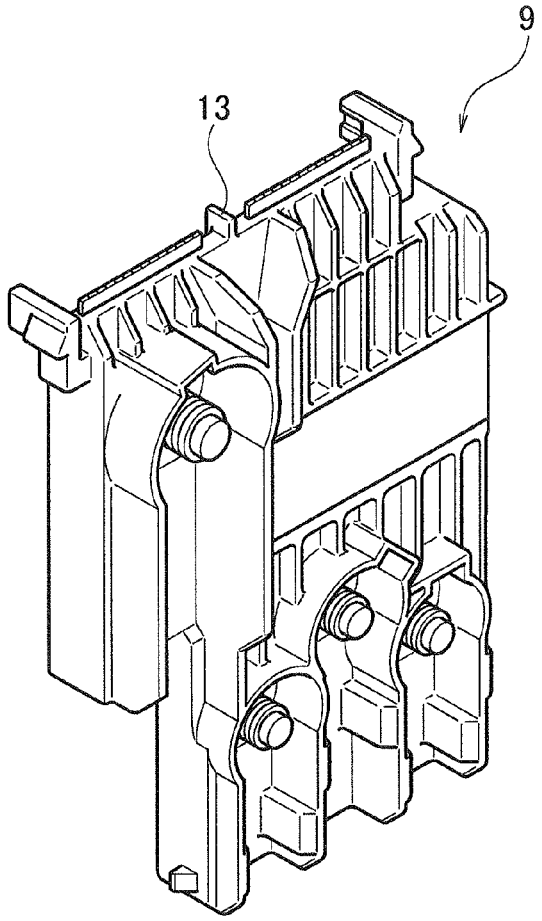
FIG. 3A is a perspective view of one divided body of the fuse unit according to the first embodiment of the present invention.
Figure 3B:
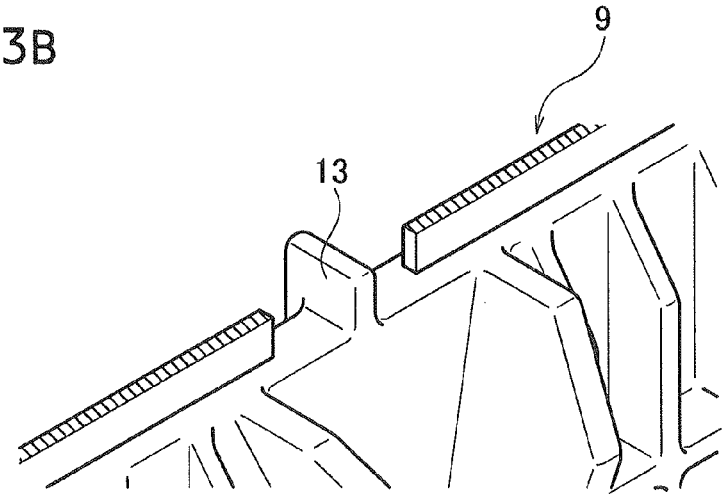
FIG. 3B is an essential part enlarged diagram of FIG. 3A.
Figure 4A:
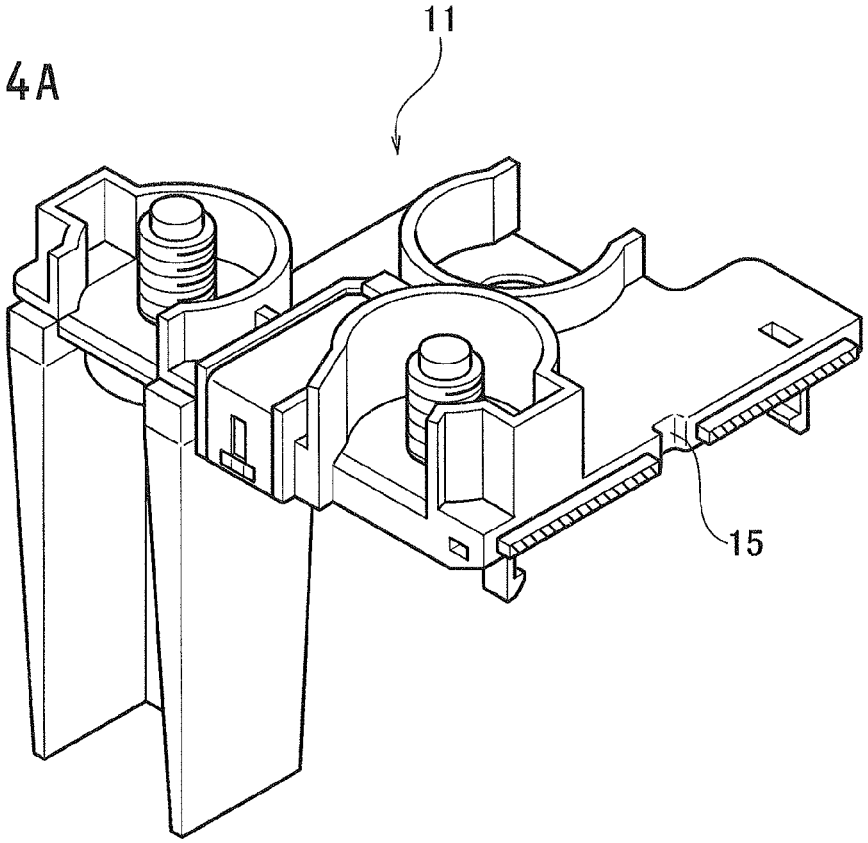
FIG. 4A is a perspective view of the other divided body of the fuse unit according to the first embodiment of the present invention.
Figure 4B:
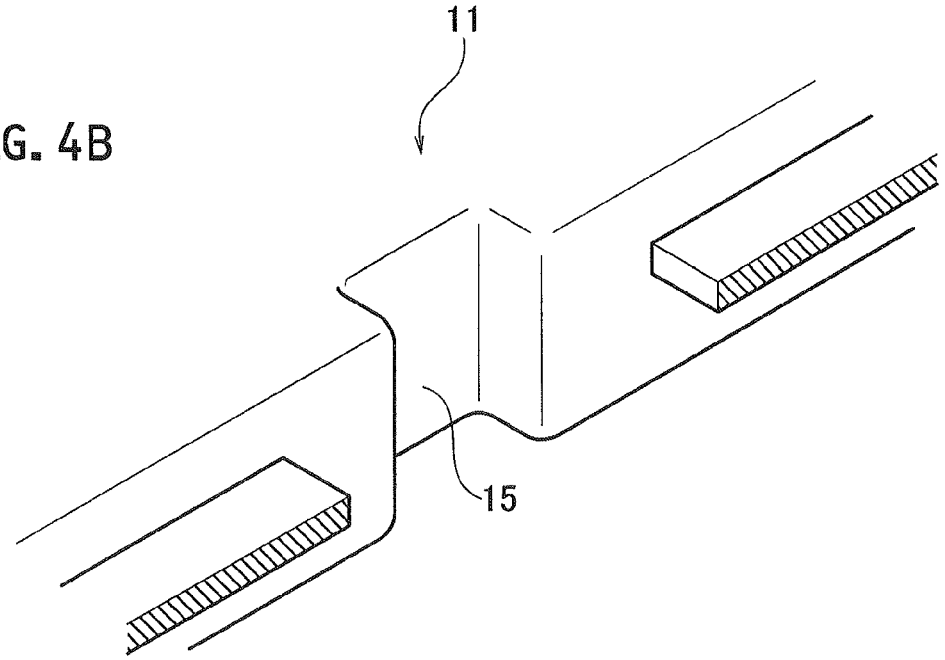
FIG. 4B is an essential part enlarged diagram of FIG. 4A.

In the bus bar 7 provided with these bend parts 3, 5, the one pair of divided bodies 9, 11 is insert-molded in a state before the bend parts 3, 5 are bent by using the bend parts 3, 5 as a boundary. As shown in FIG. 3A, the divided body 9 is insert-molded as the one-side one to be located on the side-surface side of the battery, and as shown in FIG. 4A, the divided body 11 is insert-molded as the other-side one to be located on the upper surface side of the battery. Although the divided bodies 9, 11 are stated in individually cut-apart states in FIG. 3A and FIG. 4A, the divided bodies 9, 11 are in a coupled state by using the bend parts 3, 5 as the boundary in reality.

The one pair of divided bodies 9, 11 is made of a synthetic resin material and is molded integrally with the bus bar 7 by using a die and so forth such that the bus bar 7 is built into the both. When the one pair of divided bodies 9, 11 is molded integrally with the bus bar 7, the bend parts 3, 5 of the bus bar 7 are brought into the exposed states so as to make the bend parts 3, 5 of the bus bar 7 bendable.

Figure 2:
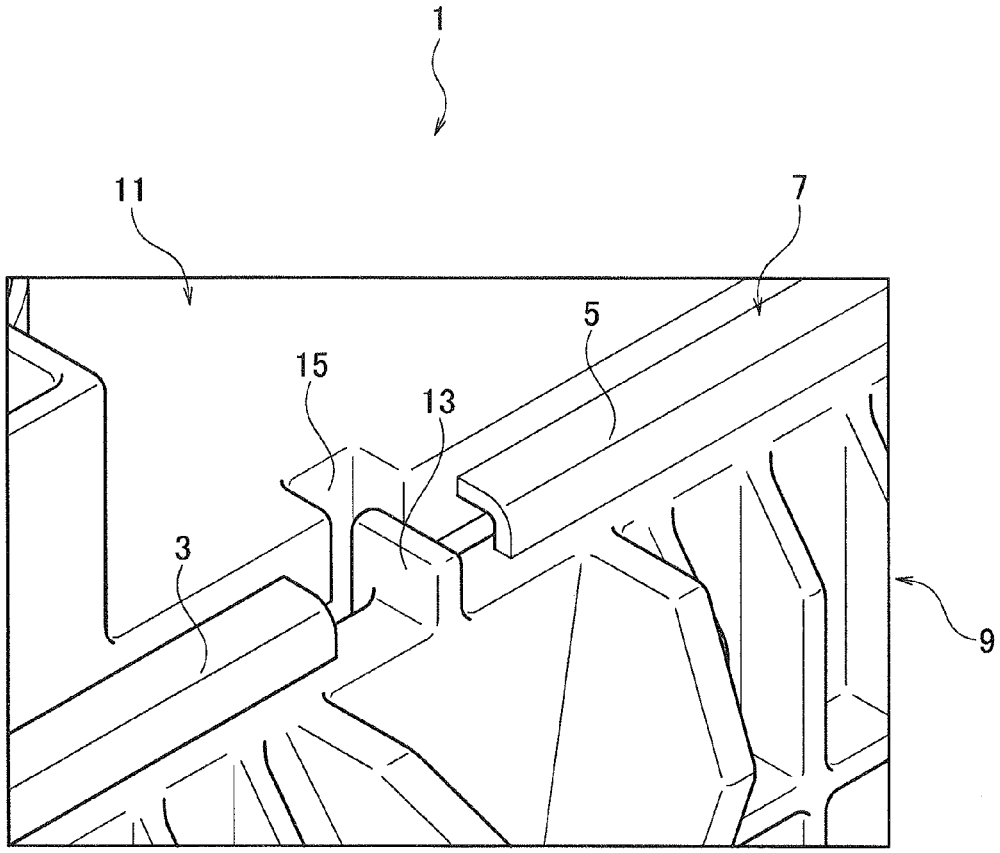
FIG. 2 is an essential part enlarged diagram of the fuse unit according to the first embodiment of the present invention.

Since the bend parts 3, 5 that are exposed from the one pair of divided bodies 9, 11 in this way configure the different fuse circuits respectively, it is necessary to insulate them from each other and thus they are arranged apart from each other. However, since the bend parts 3, 5 are exposed, the bend parts 3, 5 are electrically conducted together due to the atmospheric discharges and so forth and there is the possibility that leakage may occur. Therefore, as shown in FIG. 1 and FIG. 2, the partition wall 13 that is to be arranged between the bend parts 3 5 in a state of leaving the bend parts 3, 5 bent is provided on the divided body 9.

The partition wall 13 is arranged between the bend parts 3, 5 of one divided body 9 projecting toward the other divided body 11 side in a state before the bend parts 3, 5 are bent. In addition, the partition wall 13 is formed larger than facing surfaces of the bend parts 3, 5 so as not to mutually face side surfaces of the bend parts 3, 5 in the state of leaving the bend parts 3, 5 bent.

This partition wall 13 is arranged between the bend parts 3, 5 in the state of leaving the bend parts 3, 5 bent, that is, in a state of leaving the one pair of divided bodies 9, 11 arranged into the L-letter shape. A creeping distance between the bend parts 3, 5 is increased owing to arrangement of the partition wall 13 between the bend parts 3, 5 and the leakage between the bend parts 3, 5 can be prevented.

On the other hand, the isolation depression part 15 into which the partition wall 13 is to be arranged is provided in the other divided body 11. The isolation depression part 15 is provided between the bend parts 3, 5 so as to cover the periphery of the partition wall 13. This isolation depression part 15 is arranged on the periphery of the partition wall 13 in the state of leaving the bend parts 3, 5 bent. Thus, the creeping distance between the bend parts 3, 5 is more increased by an inner surface of the isolation depression part 15, and the leakage between the bend parts 3, 5 can be further prevented.

Since in the fuse unit 1 like this, the partition wall 13 to be arranged between the bend parts 3, 5 in the state of leaving the bend parts 3, 5 bent is provided on one divided body 9, the creeping distance between the bend parts 3, 5 is increased owing to arrangement of the partition wall 13 between the bend parts 3, 5, and the leakage between the bend parts 3, 5 can be prevented.

Therefore, since in the fuse unit 1 like this, the partition wall 13 is arranged between the bend parts 3, 5 in the state of leaving the bend parts 3, 5 bent, the leakage between the bend parts 3, 5 exposed from the one pair of divided bodies 9, 11 can be prevented.

In addition, since the isolation depression part 15 into which the partition wall 13 is to be arranged in the state of leaving the bend parts 3, 5 bent is provided in the other divided body 11, it results in arrangement of the partition wall 13 and the isolation depression part 15 between the bend parts 3, 5, and the creeping distance between the bend parts 3, 5 is more increased and the leakage between the bend parts 3, 5 can be further prevented.

Second Embodiment

A second embodiment will be described by using FIG. 5 to FIGS. 10A, 10B and 10C.

Figure 5:
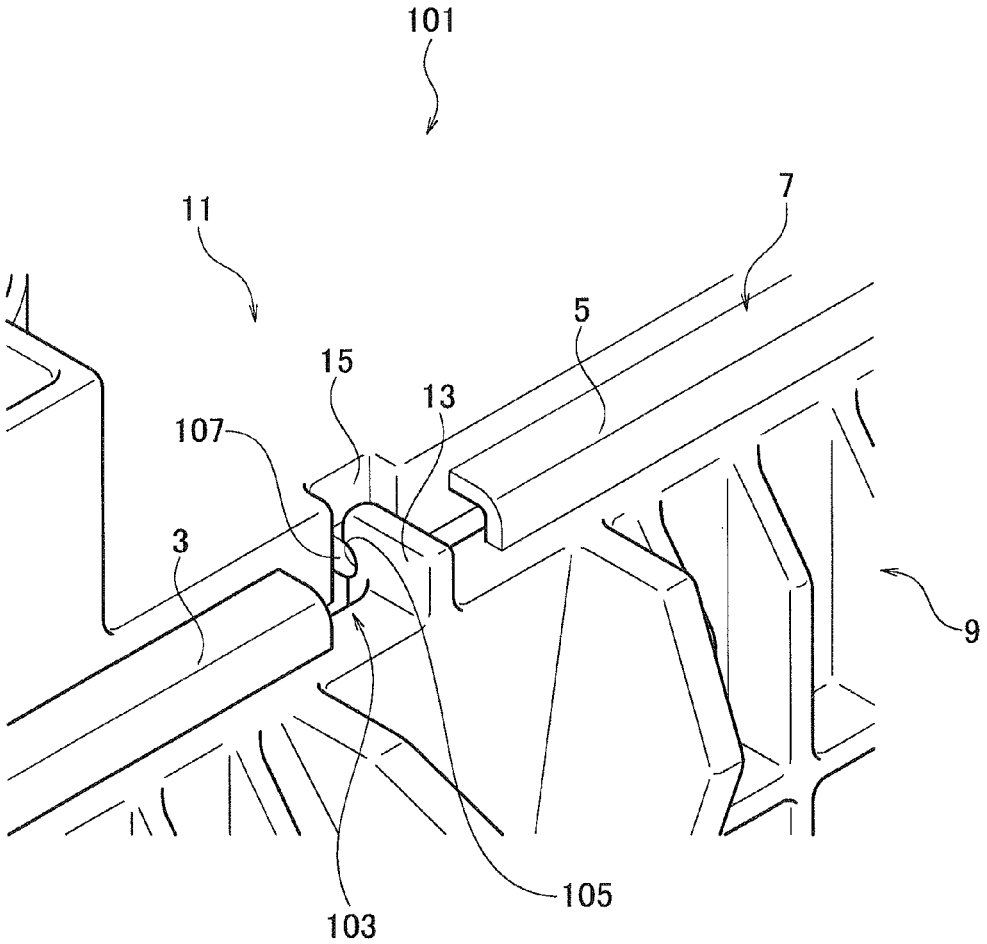
FIG. 5 is an essential part enlarged diagram of a fuse unit according to a second embodiment of the present invention.

As shown in FIG. 5, in a fuse unit 101 according to the present embodiment, a locking part 103 that attains engagement in the state of leaving the bend parts 3, 5 bent to restrict bending of the bend parts 3, 5 is provided on the one pair of divided bodies 9, 11.

In addition, the locking part 103 has a locking depression part 105 that is provided in the partition wall 13 and a locking projection part 107 that is provided on the other divided body 11 and is to be engaged with the locking depression part 105.

Incidentally, although the same symbols are assigned to the same configurations as those in the first embodiment and configurational and functional description thereof is omitted on condition that the first embodiment is to be referred to, since they are the same configurations as those in the first embodiment, the obtained effects are the same.

As shown in FIG. 5 to FIGS. 9A and 9B, the locking part 103 that restricts bending of the bend parts 3, 5, that is, maintains the L-letter shape of the one pair of divided bodies 9, 11 is provided on the one pair of divided bodies 9, 11. This locking part 103 is provided with the locking depression part 105 and the locking projection part 107 that are engaged with each other in the state of leaving the bend parts 3, 5 bent.

Figure 6A:
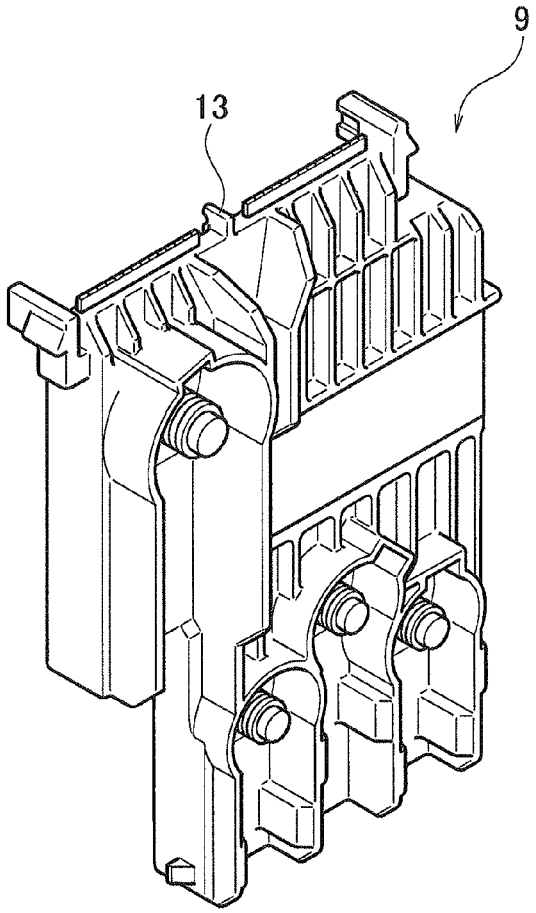
FIG. 6A is a perspective view of one divided body of the fuse unit according to the second embodiment of the present invention.
Figure 6B:
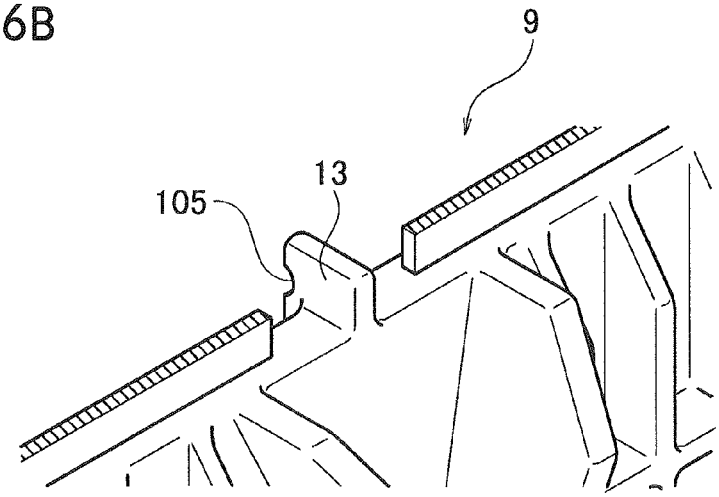
FIG. 6B is an essential part enlarged diagram of FIG. 6A.

As shown in FIG. 6B, the locking depression part 105 is provided in the partition wall 13 of one divided body 9 in a semicircle. This locking depression part 105 is arranged in opposition to the isolation depression part 15 in the other divided body 11 in the state of leaving the bend parts 3, 5 bent. The locking projection part 107 is engaged with the locking depression part 105 like this in the state of leaving the bend parts 3, 5 bent.

Figure 7A:
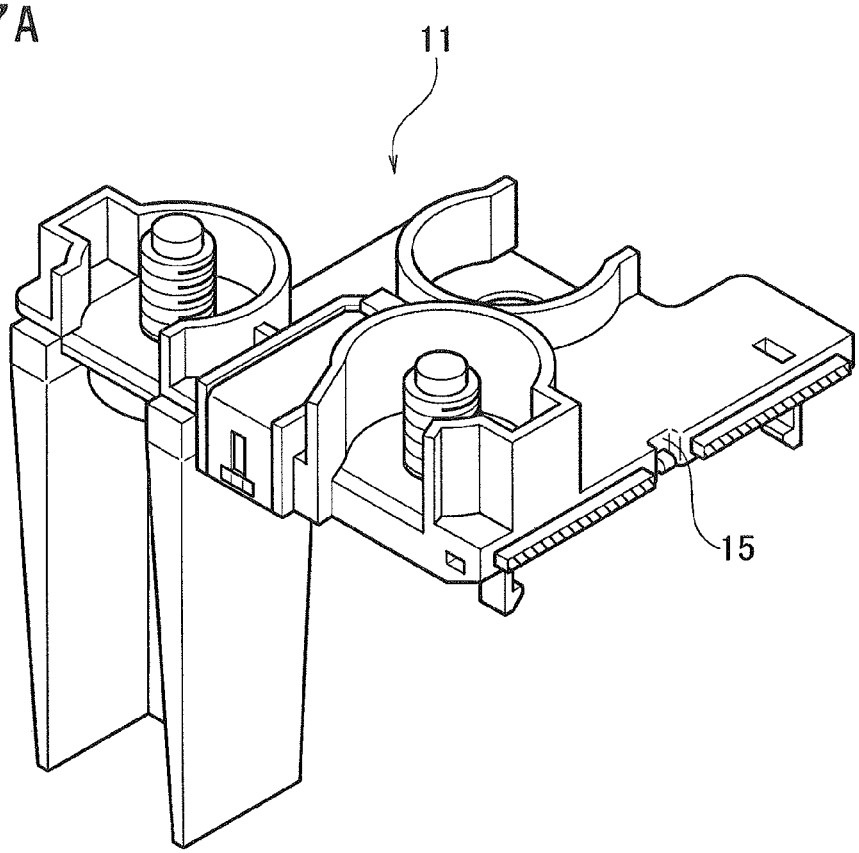
FIG. 7A is a perspective view of the other divided body of the fuse unit according to the second embodiment of the present invention.
Figure 7B:
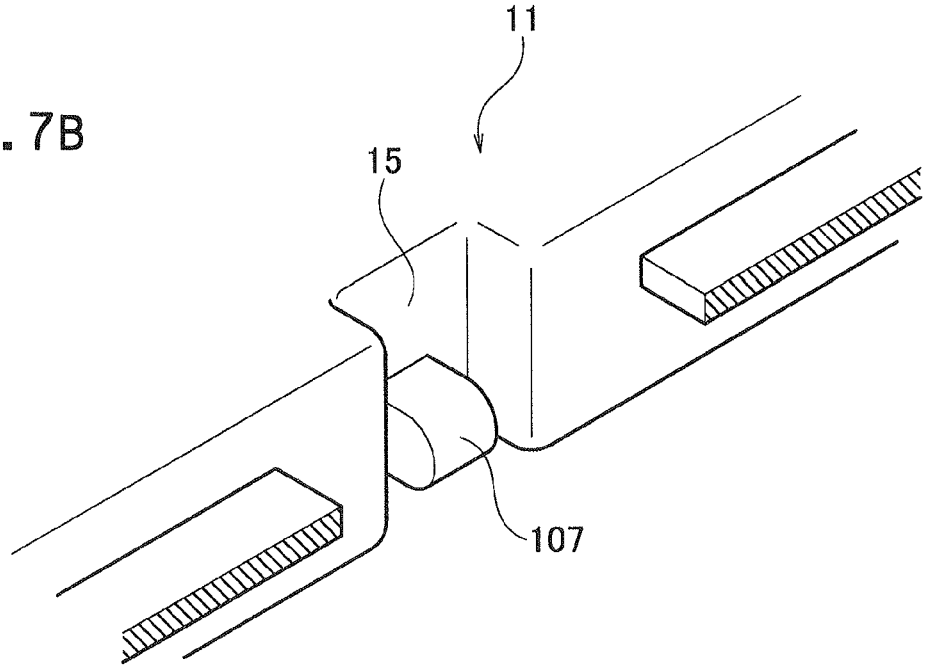
FIG. 7B is an essential part enlarged diagram of FIG. 7A.
Figure 8:
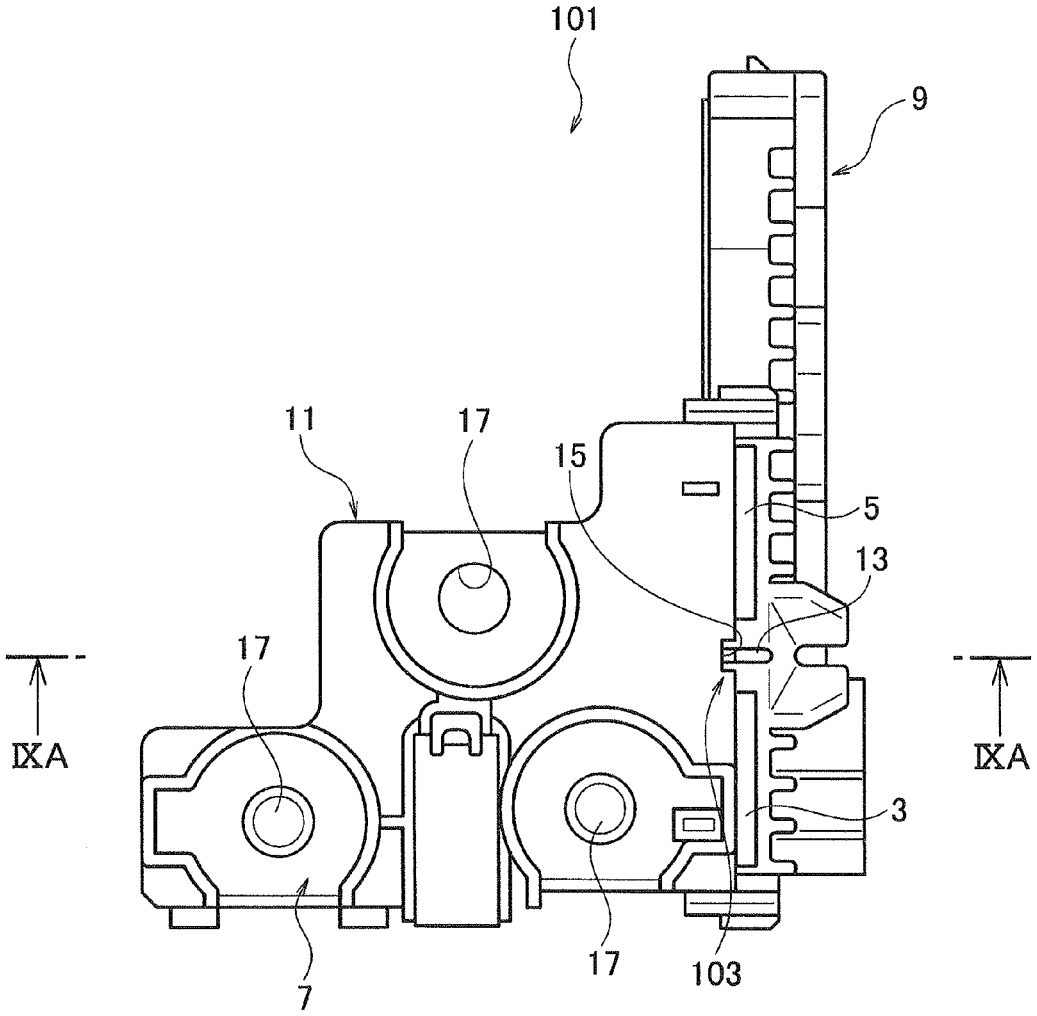
FIG. 8 is a top view of the fuse unit according to the second embodiment of the present invention.

As shown in FIG. 7B, the locking projection part 107 is projectingly arranged in the isolation depression part 15 in the other divided body 11 and its leading end side is formed in a semicircle. This locking projection part 107 is engaged with the locking depression part 105 in the state of leaving the bend parts 3, 5 bent, that is, in the state of leaving the one pair of divided bodies 9, 11 arranged into the L-letter shape. Movements in a direction that the one pair of divided bodies 9, 11 is opened and in a direction that it is closed from the L-letter shape are restricted and bending of the bend parts 3, 5 is restricted owing to engagement of this locking projection part 107 with the locking depression part 105.

Figure 9A:
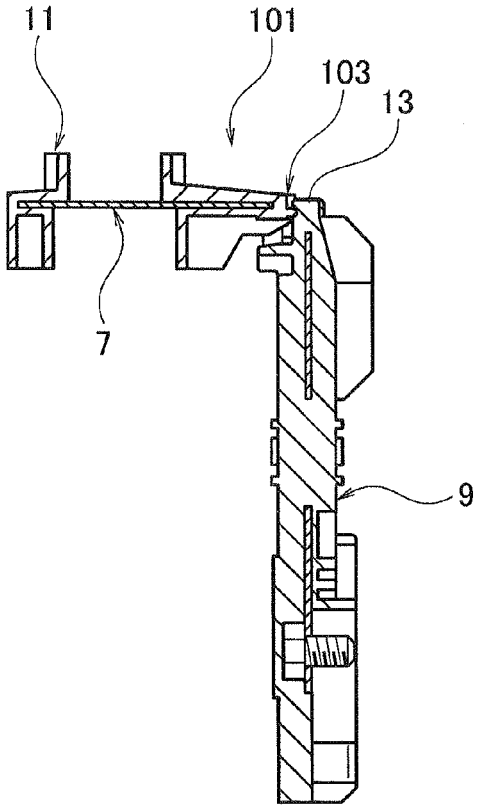
FIG. 9A is a sectional diagram along IXA-IXA in FIG. 8.
Figure 9B:
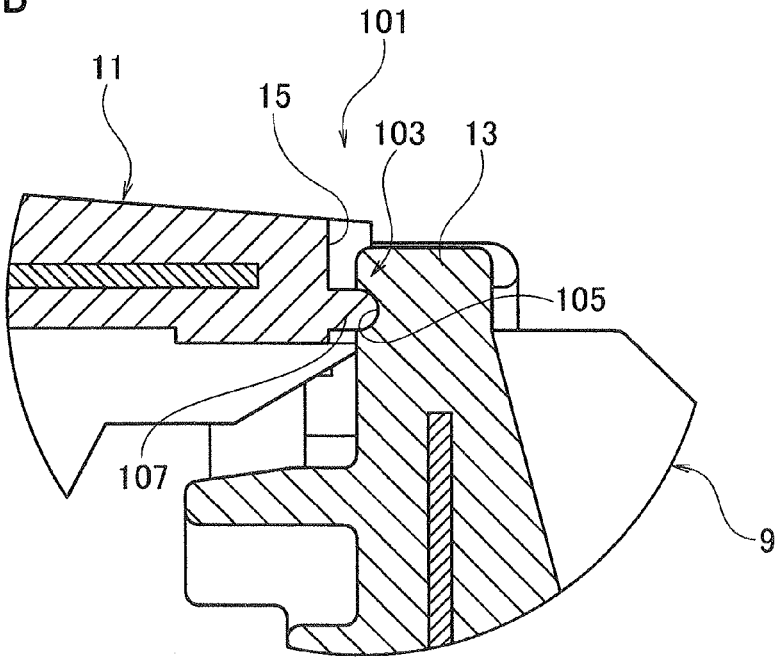
FIG. 9B is an essential part enlarged diagram of FIG. 9A.

In the locking part 103 so configured, a leading end face of the locking projection part 107 is arranged in opposition to a leading end face of the partition wall 13 in a state that the bend parts 3, 5 are not bent. The leading end face of the locking projection part 107 comes closer to the locking depression part 105 while sliding with the partition wall 13 in the middle of bending the bend parts 3, 5 out of this state. Then, as shown in FIG. 9A and FIG. 9B, the locking projection part 107 is engaged with the locking depression part 105 in a state that the bend parts 3, 5 have been completely bent and bending of the bend parts 3, 5 is restricted.

Since in the fuse unit 101 like this, the locking part 103 that attains engagement in the state of leaving the bend parts 3, 5 bent to restrict bending of the bend parts 3, 5 is provided on the one pair of divided bodies 9, 11, the state that one pair of divided bodies 9, 11 has been arranged into the L-letter shape can be stably maintained.

In addition, since the locking part 103 has the locking depression part 105 that is provided in the partition wall 13 and the locking projection part 107 that is provided on the other divided body 11 and is to be engaged with the locking depression part 105, prevention of the leakage between the bend parts 3, 5 and maintenance of the L-letter shape of the one pair of divided bodies 9, 11 can be attained at one place and a structure can be simplified.

Figure 10A:
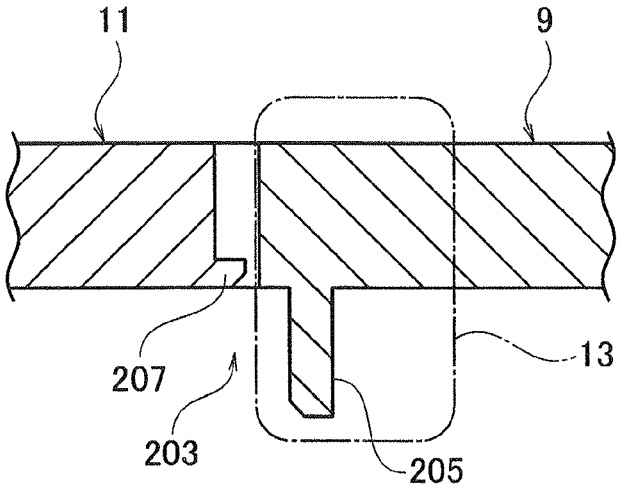
FIG. 10A is a sectional diagram showing a locking part before a bend part of a fuse unit according to a modified example of the present invention is bent.
Figure 10B:
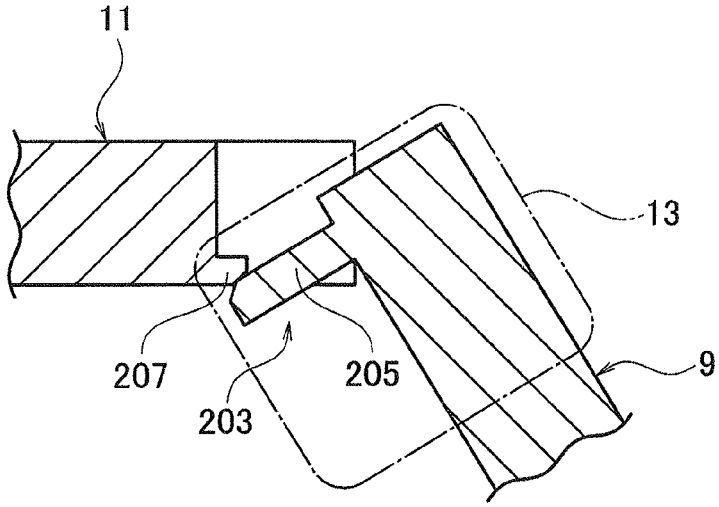
FIG. 10B is a sectional diagram showing the locking part in the middle of bending the bend part of the fuse unit according to the modified example of the present invention.
Figure 10C:
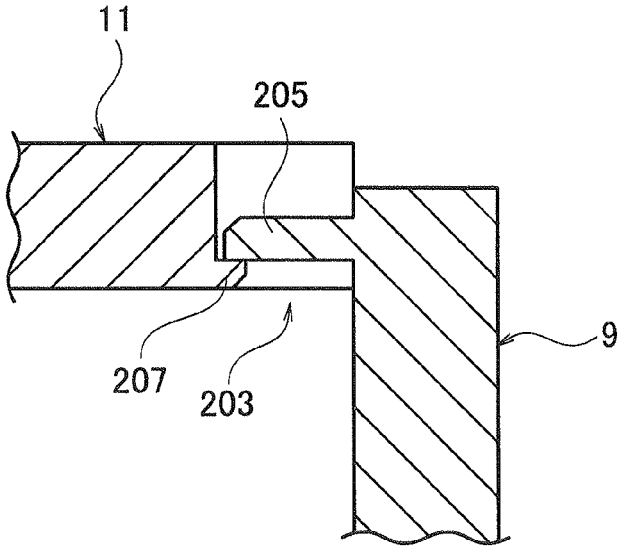
FIG. 10C is a sectional diagram showing the locking part after the bend part of the fuse unit according to the modified example of the present invention has been bent.

Incidentally, as the locking part for restricting bending of the bend parts 3, 5, there may be used a locking part 203, for example, as shown in FIG. 10A, FIG. 10B and FIG. 10C. Describing in detail, the locking part 203 includes a locking projection part 205 that is provided in the vicinity of the partition wall 13 and is provided on one divided body 9 and a locked projection part 207 that is provided on the other divided body 11.

The locking projection part 205 is flexible and is projected from a lower surface of one divided body 9 in the state that the bend parts 3, 5 are not bent, and an inclined plane is provided on its leading end side (FIG. 10A). The locked projection part 207 is projected from a side surface of the other divided body 11 toward the one divided body 9 side and an inclined plane is provided on its leading end side.

In the locking part 203 so configured, the locking projection part 205 and the locked projection part 207 are arranged 90° out of phase in the state that the bend parts 3, 5 are not bent. In the middle of bending the bends part 3, 5 out of this state, the inclined plane of the locking projection part 205 and the inclined plane of the locked projection part 207 slide (FIG. 10B), and the locking projection part 205 deflects and climbs over the locked projection part 207. Then, the locking projection part 205 is positioned on an upper surface of the locked projection part 207 in the state that the bend parts 3, 5 have been completely bent (FIG. 10C).

In this engaged state of the locking part 203, when the one pair of divided bodies 9, 11 intends to move in the direction that they are opened from the L-letter shape, a lower surface of the locking projection part 205 abuts on the upper surface of the locked projection part 207 and bending of the bend parts 3, 5 is restricted. On the other hand, when the one pair of divided bodies 9, 11 intends to move in the direction that they are closed from the L-letter shape, the leading end surface of the locking projection part 205 abuts on the side surface of the other divided body 11 and bending of the bend parts 3, 5 is restricted.

Incidentally, although the fuse units according to the embodiments of the present invention has two bend parts of the bus bar and the bend parts are separated from each other, it is not limited to this and the fuse unit may have two or more bent parts separated from each other. In a case of such bend parts, the partition wall may be provided on either one of the pair of divided bodies such that the partition wall is arranged between the adjacent bend parts.

In addition, although the partition wall is provided on one divided body, it may be provided on the other divided body. Further, although the locking depression part of the locking part is provided in the partition wall and the locking projection part is provided on the other divided body, the locking depression part may be provided in the other divided body and the locking projection part may be provided on the partition wall.

INDUSTRIAL APPLICABILITY

According to the present invention, the fuse unit capable of preventing the leakage between the bend parts that have been exposed from the one pair of divided bodies can be provided.

REFERENCE SIGNS LIST

1, 101 fuse unit
3, 5 bend part
7 bus bar
9, 11 one pair of divided bodies
13 partition wall
15 isolation depression part
103, 203 locking part
105 locking depression part
107 locking projection part

The invention claimed is:

1. A fuse unit, comprising:

a bus bar whose at least two bend parts separated from each other are arranged in parallel, wherein the bend parts are exposed portions of the bus bar; and one pair of divided bodies formed by being divided into one side and the other side of the bus bar with the bend parts exposed, the one pair of divided bodies being arranged into an L-letter shape by being bent at the bend parts, wherein a partition wall that is to be arranged between the bend parts in a state of leaving the bend parts bent is provided on either one of the one pair of divided bodies so as to increase a creepage distance between the bend parts; and wherein a height of the partition wall is greater than a height of the bend parts in an extension direction of the one pair of divided body, wherein the fuse unit is in a state of leaving the bend parts bent when the fuse unit is in the bent state.

2. The fuse unit according to claim 1, wherein an isolation depression part that is provided between the bend parts and in which the partition wall is to be arranged in the state of leaving the bend parts bent is provided in the other one of the one pair of divided bodies.

3. The fuse unit according to claim 2, wherein a locking part that attains engagement in the state of leaving the bend parts bent to restrict bending of the bend parts is provided on the one pair of divided bodies.

4. The fuse unit according to claim 3, wherein the locking part comprises:

a locking depression part that is provided in one of the partition wall and the other divided body; and a locking projection part that is provided on the other one of the partition wall and the other divided body and is to be engaged with the locking depression part.

5. The fuse unit according to claim 1, wherein a locking part that attains engagement in the state of leaving the bend parts bent to restrict bending of the bend parts is provided on the one pair of divided bodies.

6. The fuse unit according to claim 5, wherein the locking part comprises:

a locking depression part that is provided in either one of the partition wall or the other divided body; and a locking projection part that is provided on the other one of the partition wall or the other divided body and is to be engaged with the locking depression part.

* * * * *